US009540845B1

(12) United States Patent
Yang

(10) Patent No.: US 9,540,845 B1
(45) Date of Patent: Jan. 10, 2017

(54) LOCK UNIT WITH A ROOM THEREIN

(71) Applicant: Yao-Kun Yang, Taichung (TW)

(72) Inventor: Yao-Kun Yang, Taichung (TW)

( * ) Notice: Subject to any disclaimer, the term of this patent is extended or adjusted under 35 U.S.C. 154(b) by 0 days.

(21) Appl. No.: 14/798,464

(22) Filed: Jul. 14, 2015

(51) Int. Cl.
*E05B 19/00* (2006.01)
*E05B 67/02* (2006.01)
*E05B 47/00* (2006.01)
*E05B 67/22* (2006.01)

(52) U.S. Cl.
CPC ..... *E05B 19/0005* (2013.01); *E05B 47/0012* (2013.01); *E05B 67/02* (2013.01); *E05B 67/22* (2013.01)

(58) Field of Classification Search
CPC ..... E05B 47/0012; E05B 2047/0072; E05B 47/0001; E05B 67/22; E05B 67/02; E05B 17/002; E05B 19/0005; E05B 77/34; G07C 2009/00634; G07C 9/00142; G07C 9/00571; Y10T 70/491; Y10T 70/7068; Y10T 70/409; Y10T 70/459; Y10T 70/5739; Y10T 70/7107
USPC ..... 70/63, 277, 278.1, 278.7, 279.1, 21, 70/24,70/25
See application file for complete search history.

(56) References Cited

U.S. PATENT DOCUMENTS 4,838,052 A * 6/1989 Williams ..... E05B 19/0005 109/52
4,988,987 A * 1/1991 Barrett ..... G07C 1/32 235/382.5
5,280,518 A * 1/1994 Danler ..... G07C 1/32 340/5.23
5,758,522 A * 6/1998 York ..... E05B 19/0005 109/59 R
5,794,466 A * 8/1998 Hungerford ..... E05B 19/0005 109/53
6,046,558 A * 4/2000 Larson ..... G07C 1/32 318/280
6,047,575 A * 4/2000 Larson ..... E05B 47/0012 250/231.14
6,442,983 B1 * 9/2002 Thomas ..... E05B 47/0012 70/278.1
6,761,051 B1 * 7/2004 Tsai ..... E05B 47/0012 70/257
6,993,943 B1 * 2/2006 Chang ..... E05B 47/0012 70/277
7,086,258 B2 * 8/2006 Fisher ..... E05B 19/0005 70/24
7,948,359 B2 * 5/2011 Marcelle ..... G07C 9/00182 340/5.64
8,151,608 B2 * 4/2012 Fisher ..... E05B 19/0005 70/24
8,453,481 B2 * 6/2013 Meekma ..... E05B 47/0012 70/25
8,640,514 B2 * 2/2014 Goren ..... E05B 41/00 340/5.2
8,695,385 B2 * 4/2014 Meekma ..... E05B 19/0005 292/254

(Continued)

*Primary Examiner* — Suzanne Barrett
(74) *Attorney, Agent, or Firm* — Guice Patents PLLC

(57) ABSTRACT

A lock unit includes a case, an operation unit and an electric control unit. A shackle is connected to the case, and the operation unit controls the first end of the shackle to be disengaged from the case. A touch screen is connected to the outside of the cover so as to control the electric control unit which controls the operation unit to easily and quickly unlock the lock unit by popping the first end of the shackle out from the case.

8 Claims, 16 Drawing Sheets

(56) References Cited

U.S. PATENT DOCUMENTS

| | | | | |
|---|---|---|---|---|
| 8,850,858 | B2 * | 10/2014 | Nave | E05B 67/22 70/21 |
| D724,931 | S * | 3/2015 | Dudgeon | D8/334 |
| 2008/0229792 | A1 * | 9/2008 | Maple | E05B 39/00 70/275 |
| 2011/0273852 | A1 * | 11/2011 | Debrody | G09F 3/0317 361/747 |

* cited by examiner

LOCK UNIT WITH A ROOM THEREIN

BACKGROUND OF THE INVENTION

1. Fields of the Invention

The present invention relates to a lock unit, and more particularly, to a lock unit with a room for receiving goods, and a cover is provided to seal the room, the cover is operand by a touch screen.

2. Descriptions of Related Art

The conventional way to store important goods is to purpose a safety box or safety cabin, however, the safety box or safety cabin is costly so that some users may not affortable.

Another convenient way is to use a lock to lock the box for receiving the important goods, and the lock can be unlocked by using a key. Nevertheless, the key can be easily lost, and the lock has to be damaged to access the important goods in the box. An improved lock is developed and includes a conventional lock core and a combination lock unit, wherein the user uses a key to unlock the conventional lock core, and input correct numbers to unlock the combination lock. However, the combination lock requires the user to rotate the number disk one by one at correct position, once the one of the number is in correct, the lock cannot be unlocked. Therefore, the user needs a longer time to unlock the lock.

The present invention intends to provide a lock unit to improve the shortcomings mentioned above.

SUMMARY OF THE INVENTION

The present invention relates to a lock unit and comprises a case having a cover which is pivotably connected to the lower end of a base, and has a touch screen on the outside thereof. A board is located in the base to define a first room between the cover and the base. A second room is defined between the board and the base, and has a power supply area and an operation area. A power supply is located in the power supply area. A shackle has a first end and a second end, the first end of the shackle has a resilient member mounted thereto and a groove is defined in the distal end thereof. The first and second ends of the shackle are inserted into the operation area. A restriction member is connected to the inside of the cover and located close to the top inside of the cover. The restriction member has a slot defined in the central portion thereof.

An operation unit is located in the operation area and has two slides, a toothed member located between the two slides, a fixing member mounted to the two slides and a hook member. The two slides are slidable left and right relative to the inside of the base. A notch is defined in one side of each of the two slides and a spring is received in the notch. The spring is biased between the inside of the notch and the fixing member. Each slide has a control member which is located corresponding to the inside of the base. Each control member has a protrusion which protrudes toward the toothed member. The toothed member has teeth on the distal end thereof. Two shifting members respectively extend from two sides of the toothed member. The shifting members contact the protrusions of the two control members. The slide located corresponding to the toothed member has a rod extending therefrom and located opposite to the notch. The other slide is located corresponding to the groove of the shackle and has a block extending therefrom which is engaged with the groove to position the first end of the shackle. The hook member is located between the board and the fixing member. One end of the hook member is movably inserted in the slot to be engaged with the cover. The hook member has a push member which has an inclined face which contacts the rod. The hook member has a stop opposite to the push member. A tension spring is biased between the underside of the stop and an auxiliary member extending from the board.

An electric control unit has a motor and a circuit board which is connected to the underside of the touch screen of the cover and electrically connected with the touch screen and the power supply member. The motor is located between the two slides and electrically connected with the circuit board. The motor has a driving disk which is engaged with the toothed member orthogonally. The circuit board controls the motor to drive the driving disk to rotate the toothed member.

The touch screen on the cover controls the motor to control the toothed member so as to move the shifting members to move the slides. When the motor drives the driving disk clockwise, the toothed member rotates counter clockwise to move the slide located beneath the toothed member from the shackle. The first end of the shackle is pushed by the resilient member and pops out from the base. When the motor drives the driving disk counter clockwise, the toothed member rotates clockwise to move the slide located above the toothed member to move the hook member to be disengaged from the cover, so that the cover is pivoted away from the base.

Preferably, the fixing member has two pins extending therefrom and the springs are mounted to the two pins of the fixing member. Two locking members extend from two ends of the underside thereof, two bolts extend through the locking members to lock the fixing member to the base.

Preferably, the restriction member has two posts extending from two ends thereof. A spring is mounted to each post and biased between the restriction member and the inside of the cover. The cover has two tabs, and the hook member is engaged between the two tabs to restrict the cover from being pivoted away from the base.

Preferably, each of the slides has a spring connected thereto which is biased between the slide and the control member corresponding thereto so as to control a movement of the control member.

Preferably, a lock core is connected to the base and located corresponding to the first end of the shackle. The lock core has a keyhole defined in the first end thereof which is exposed from the base. The second end of the lock core in the base has a plate connected thereto, the plate has a curved member extending perpendicularly therefrom which is located between the two slides and extends toward the hook member. Each slide has an inclined face which is located corresponding to the curved member. The two respective inclined faces of the two slides are radially inclined toward opposite directions. When the lock core is rotated, the curved member is rotated to push the inclined faces of the slides which controls the first end of the shackle to be disengaged from the base so that the cover is pivoted away from the base.

Preferably, a cover piece is connected to an outside of the base. A link is connected between the cover piece and the base, the cover piece covers the first end of the lock core and the keyhole.

Preferably, the board has an opening which is communicates with the power supply area and is located corresponding to the power supply member. A cap is mounted to the opening and covers the power supply member.

Preferably, the opening has a recess defined in the top edge thereof, the cap has a resilient piece which is hooked with the recess to fix the cap.

The primary object of the present invention is to provide a lock unit wherein the user operates the touch screen to control the motor to drive the driving disk to rotate the toothed member of the operation unit so as to shift the slides and remove the hook member from the cover, so that the first end of the shackle pops out from the case, and the cover can be opened from the base. The key can also be received in the case to prevent lost of the key. The cover can also be opened by simply using the key.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
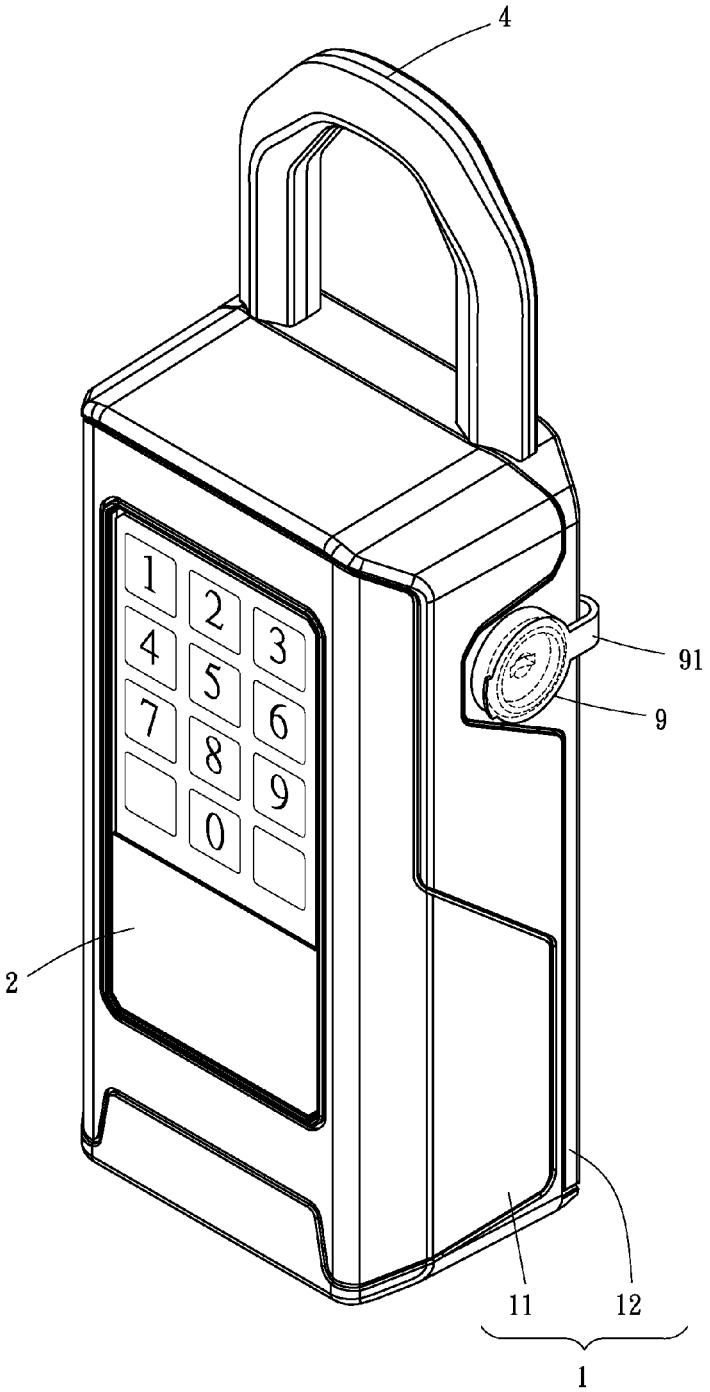
FIG. 1 is a perspective view to show the lock unit of the present invention.
Figure 2:
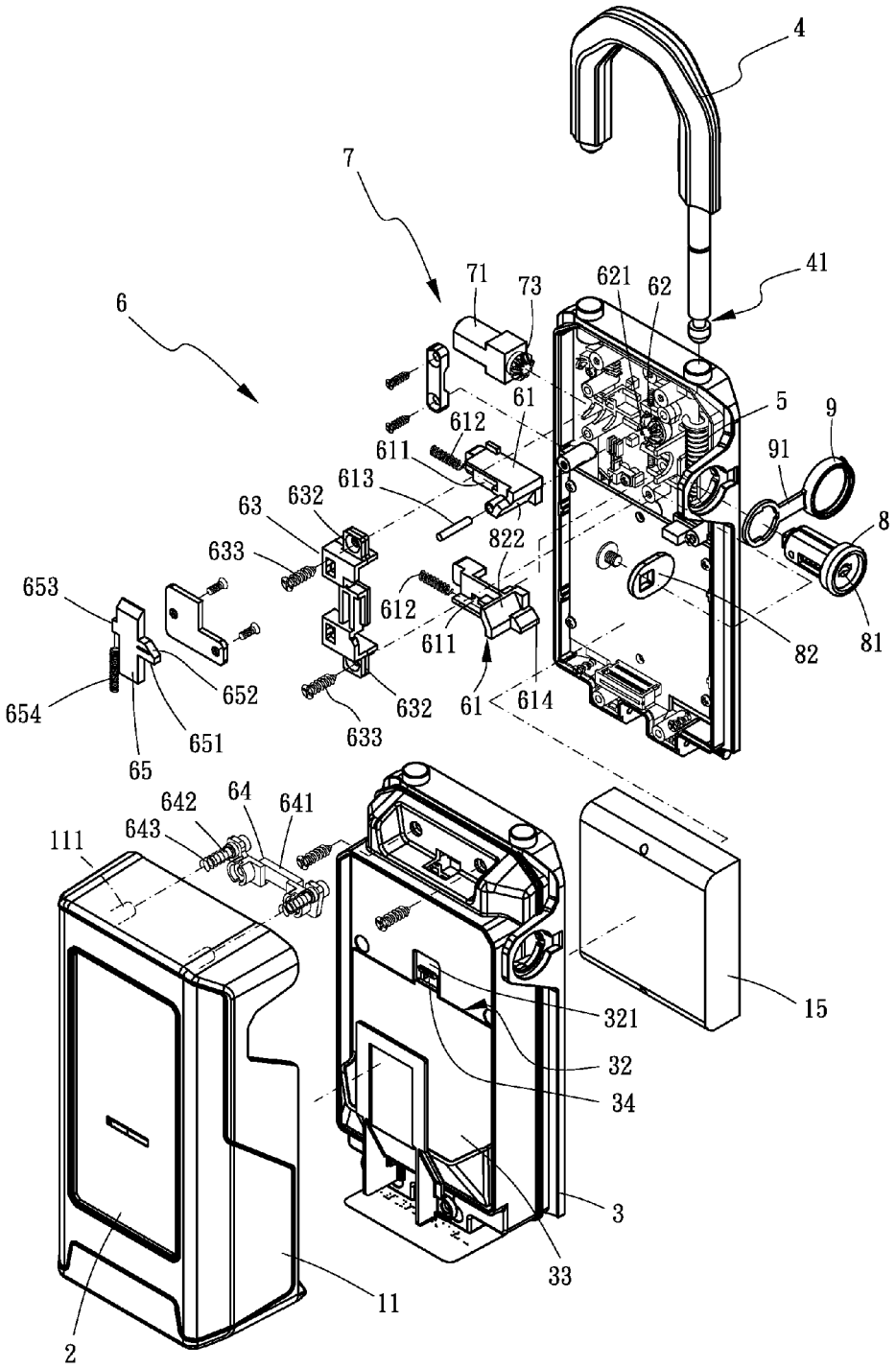
FIG. 2 is an exploded view of the lock unit of the present invention.
Figure 3:
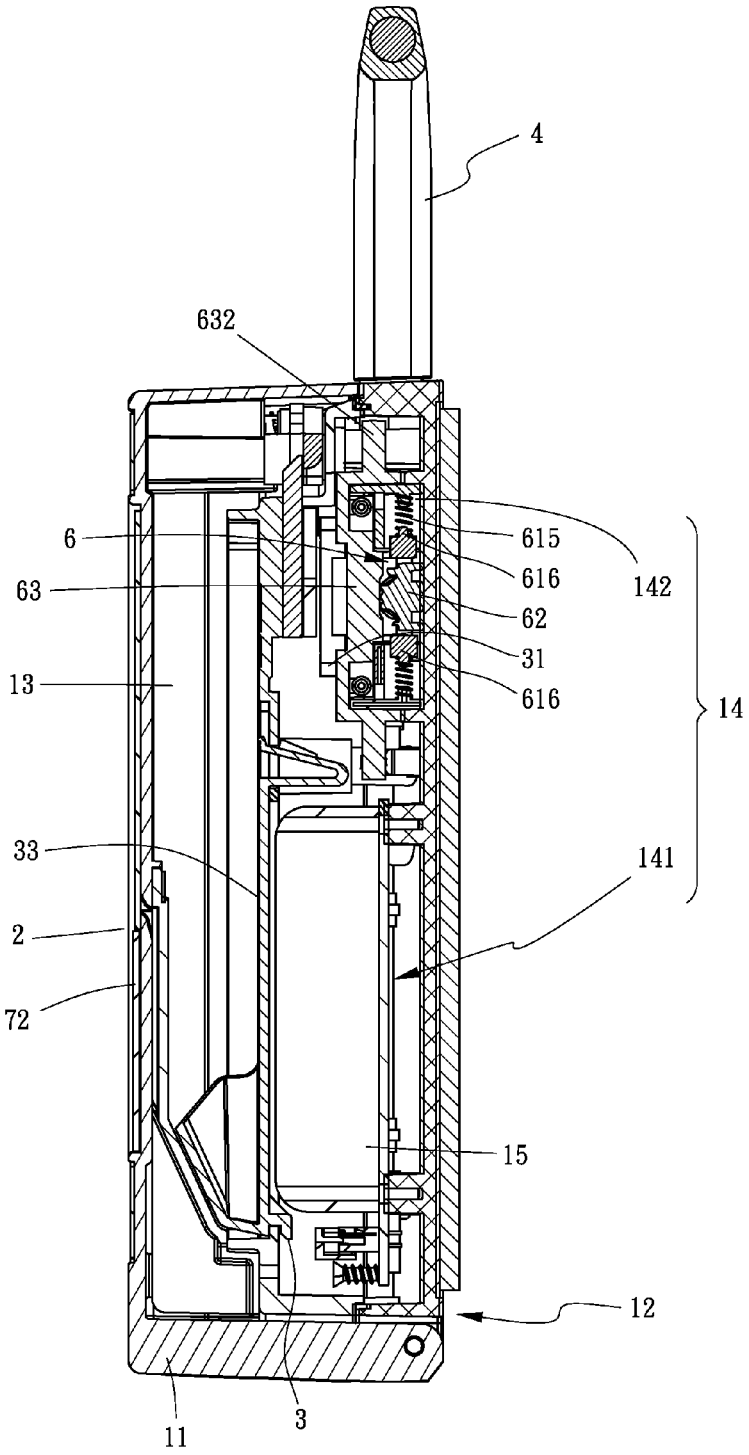
FIG. 3 is a cross sectional view of the lock unit of the present invention.
Figure 4:
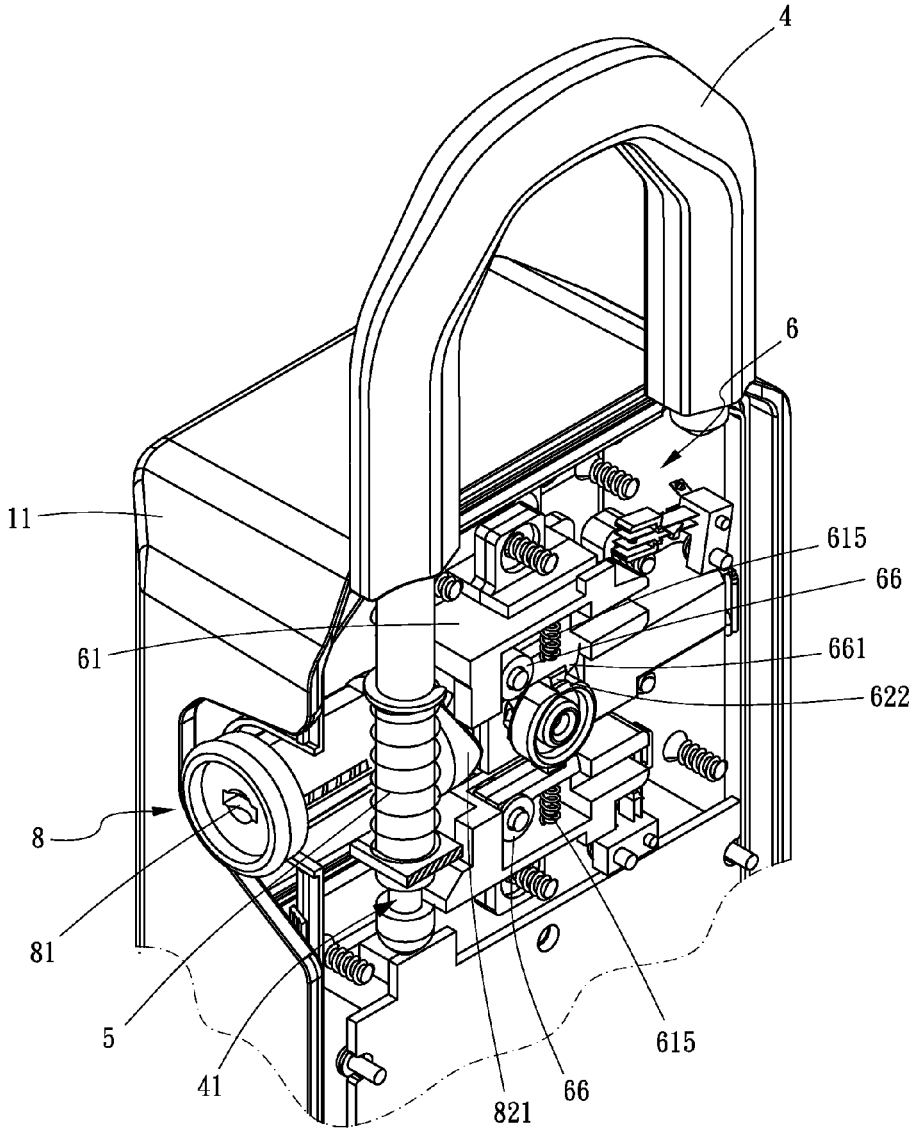
FIG. 4 shows the operation unit of the lock unit of the present invention.
Figure 5:
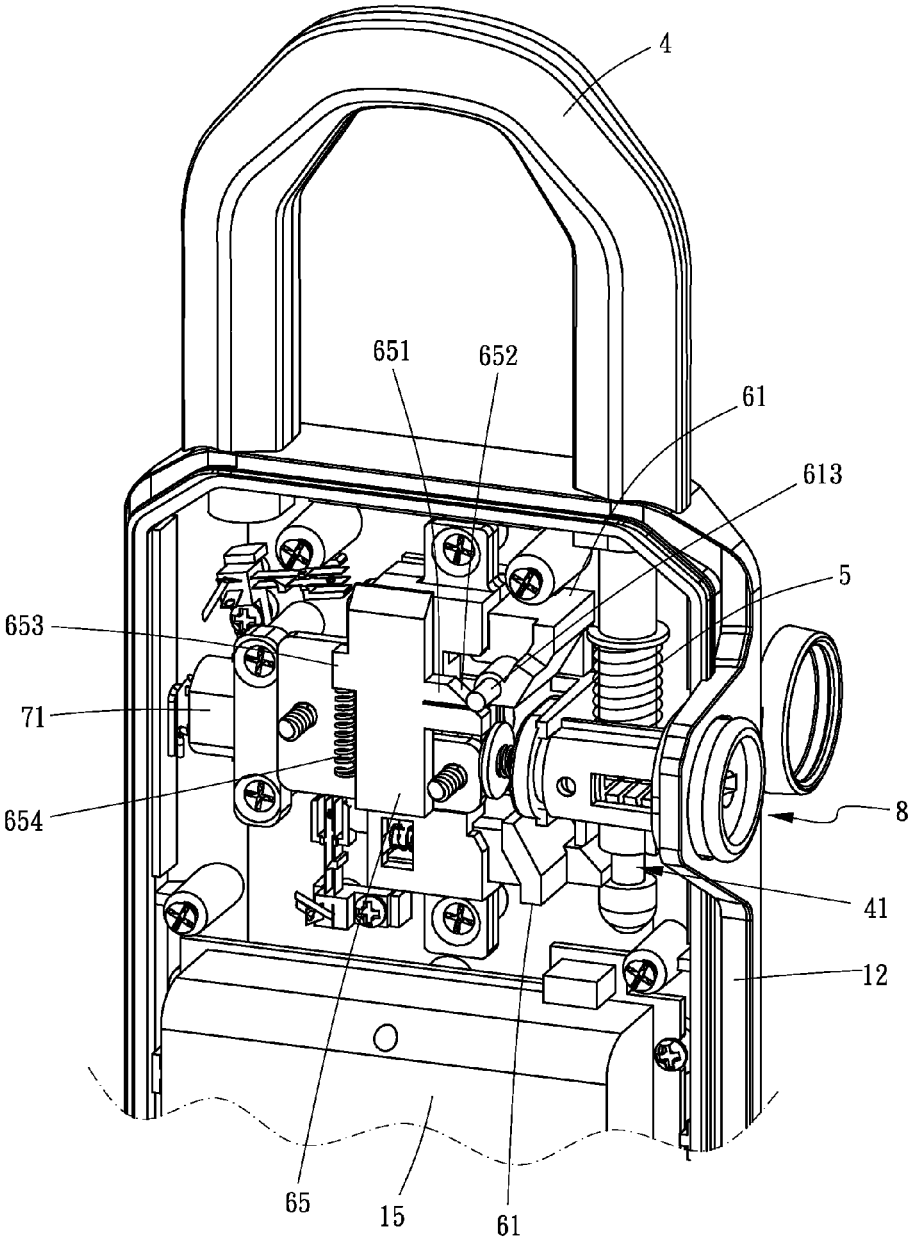
FIG. 5 shows the operation unit of the lock unit of the present invention, wherein the operation unit is not yet activated.
Figure 6:
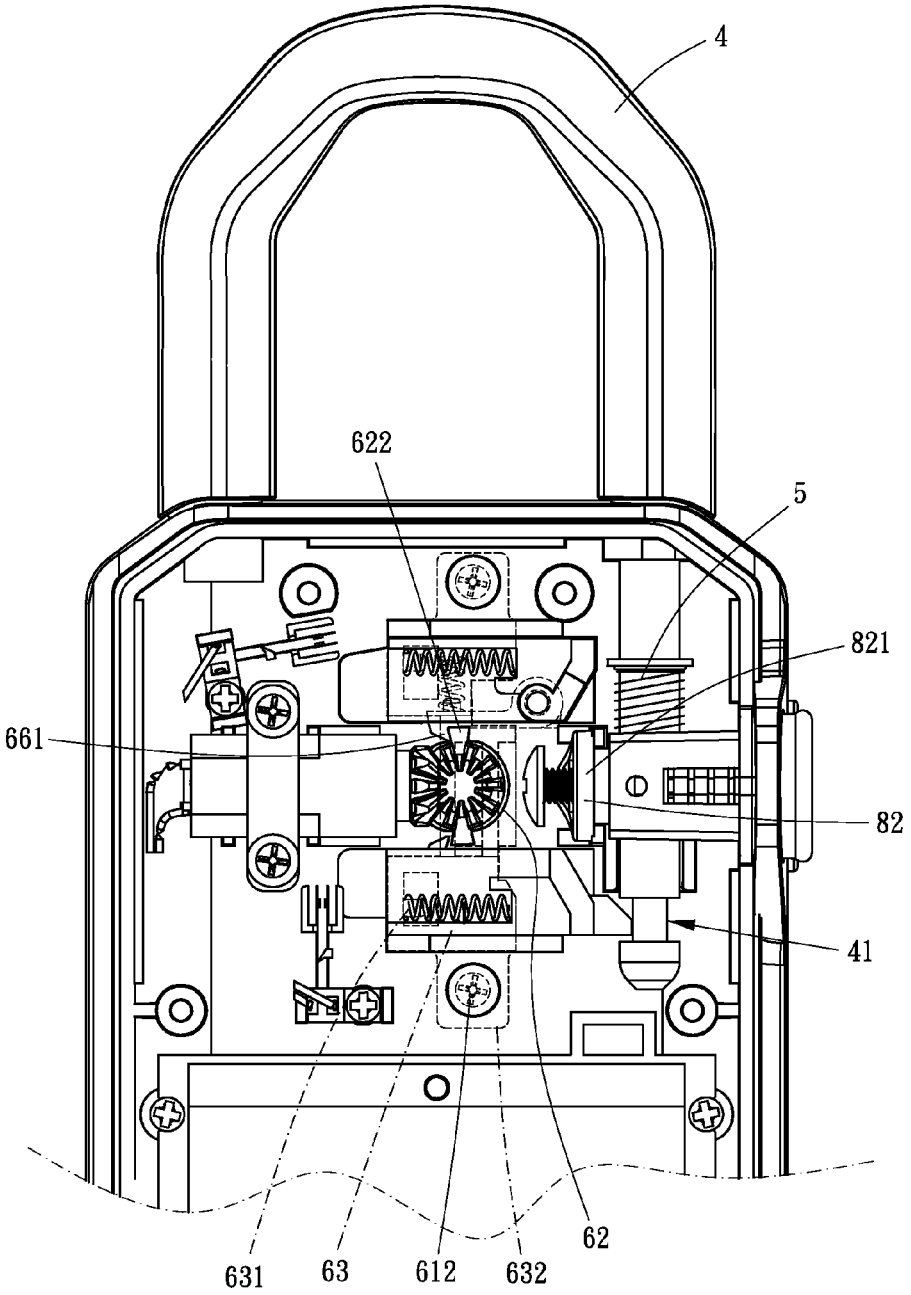
FIG. 6 further discloses the operation unit of the lock unit of the present invention.
Figure 7:
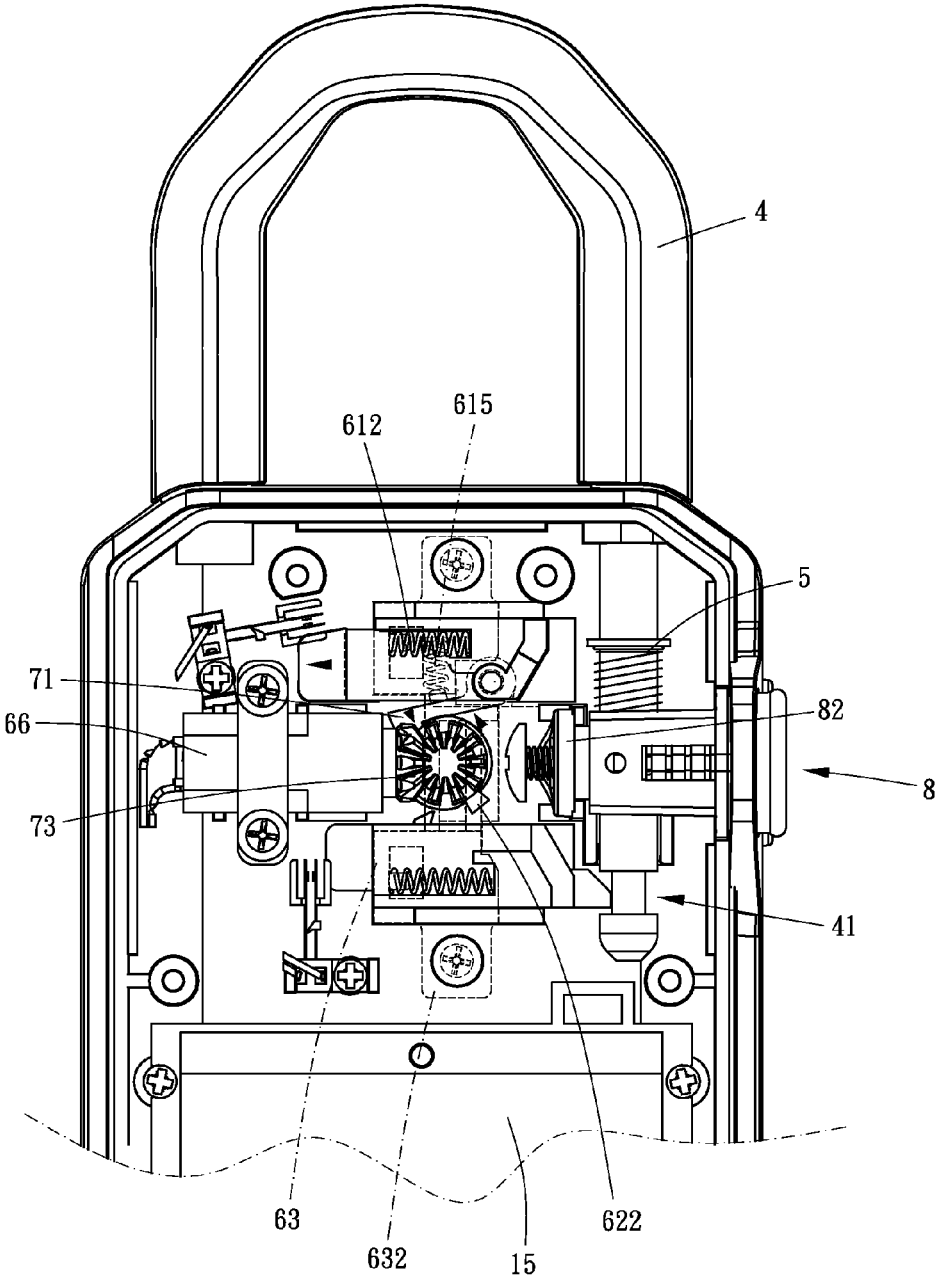
FIG. 7 shows that the motor is operated clockwise and the toothed member is rotated counter clockwise, the slide above the toothed member moves.
Figure 8:
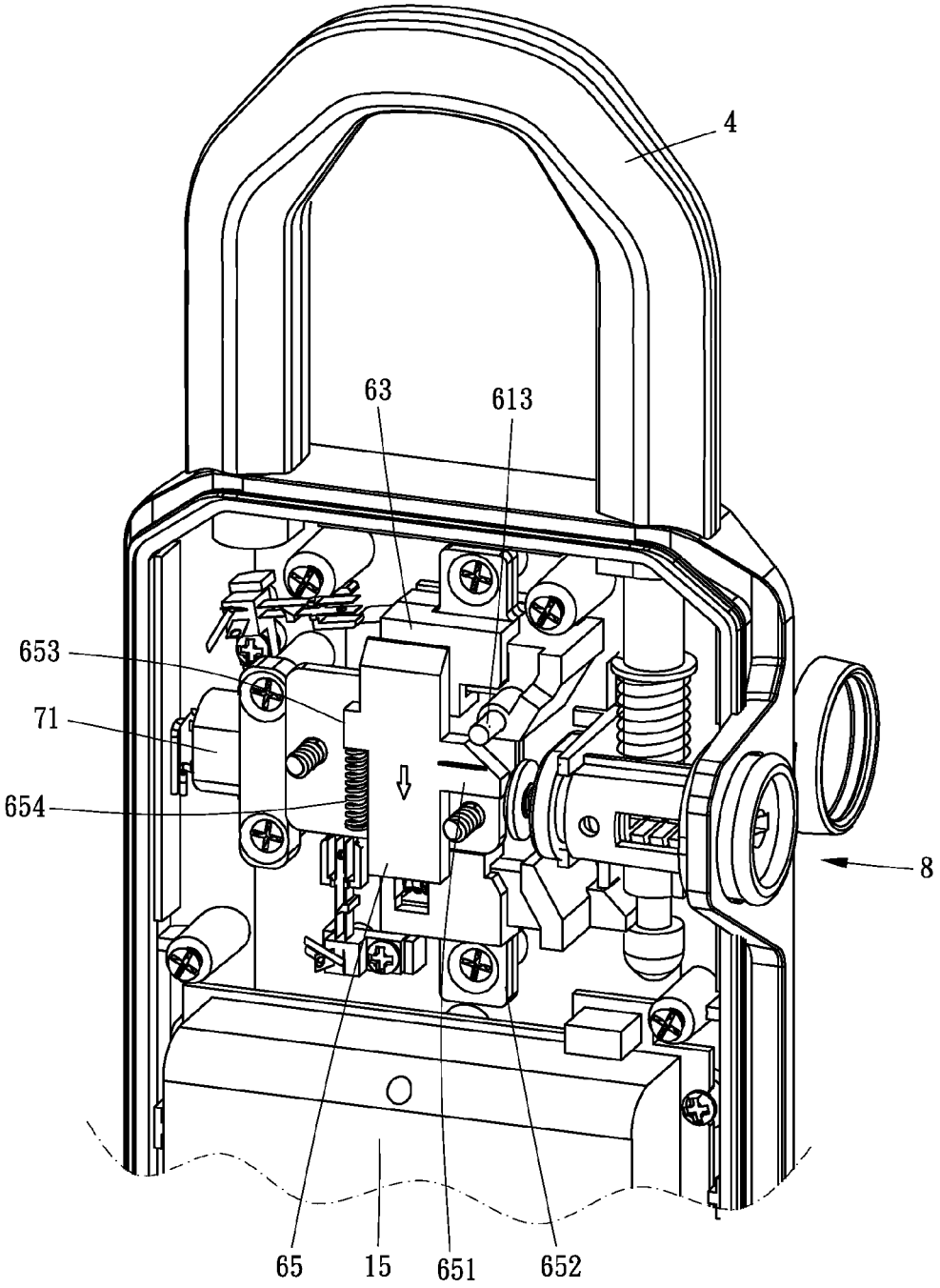
FIG. 8 shows that the hook member is pushed downward by the rod.
Figure 9:
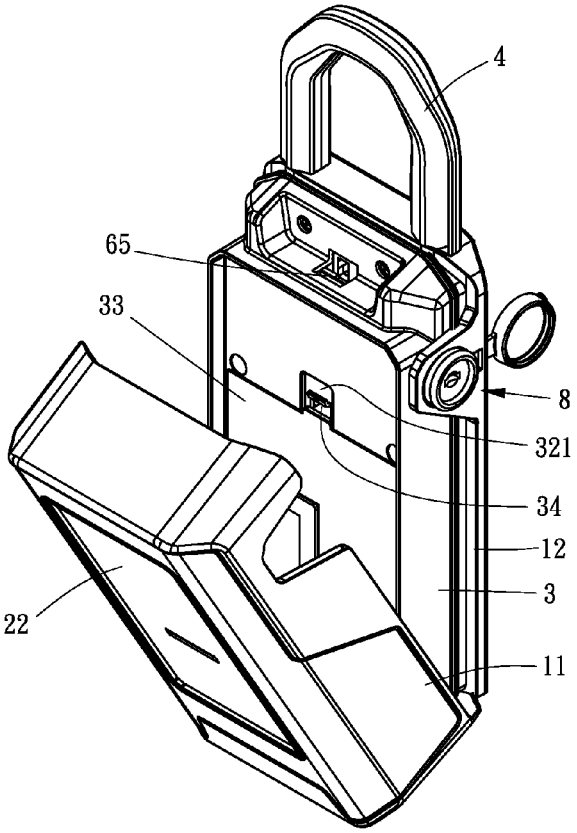
FIG. 9 shows that when the hook member is pushed downward, the hook member is disengaged from the cover which is opened from the base.
Figure 10:
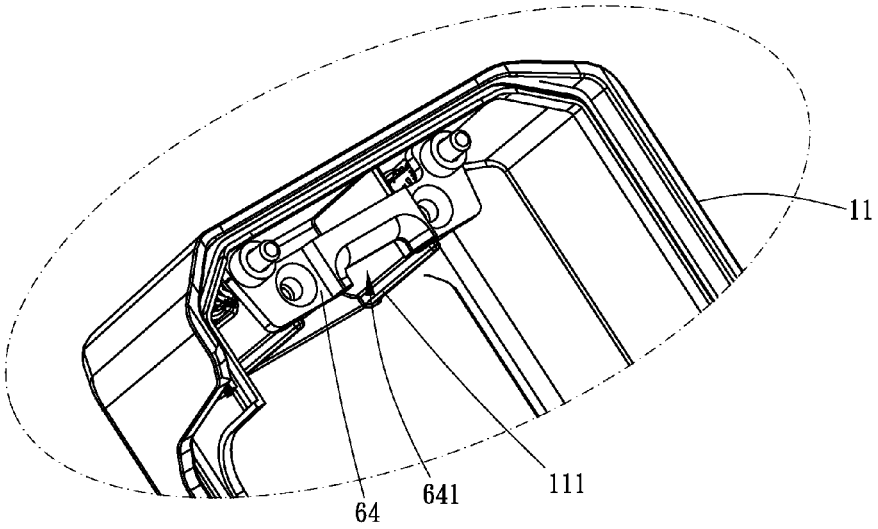
FIG. 10 is seen from another angle of the disclosure in FIG. 9.
Figure 11:
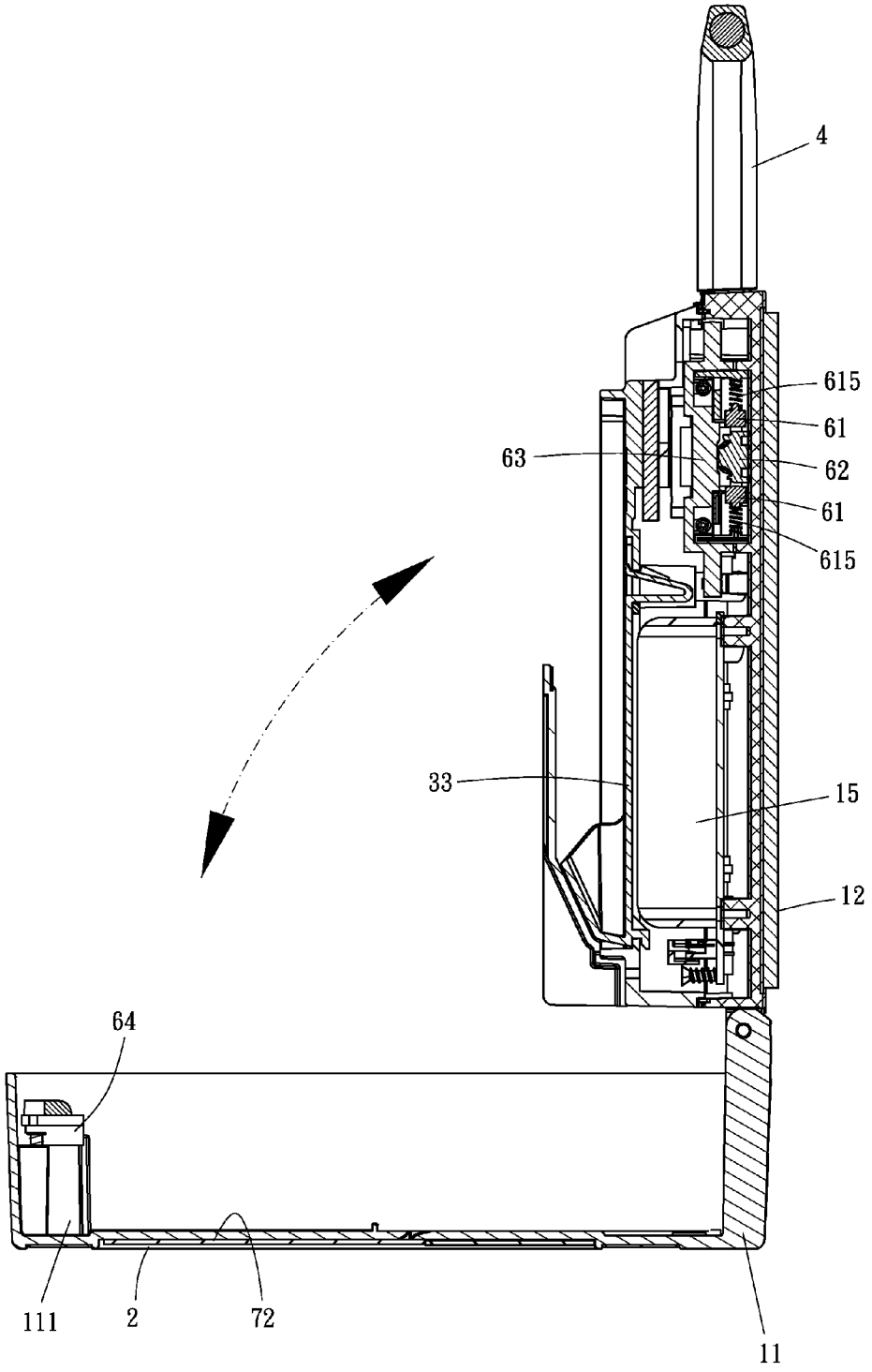
FIG. 11 shows that the cover is fully opened relative to the base.

Referring to FIGS. 1 to 4, the lock unit of the present invention comprises a rectangular case 1 having a cover 11 and a base 12. The cover 11 is pivotably connected to the lower end of the base 12 and has a touch screen 2 on the outside thereof. Aa board 3 is located in the base 12 to define a first room 13 between the cover 11 and the base 12, and a second room 14 defined between the board 3 and the inside of the base 12. The second room 14 has a power supply area 141 and an operation area 142, wherein a power supply 15 is located in the power supply area 14. A U-shaped shackle 4 has a first end and a second end, the first end of the shackle 4 has a resilient member 5 is mounted thereto and a groove 41 is defined in the distal end thereof. Both of the first and second ends of the shackle 4 are inserted into the operation area 142. A restriction member 64 is connected to the inside of the cover 11 and located close to the top inside of the cover 11. The restriction member 64 has a slot 641 defined in the central portion thereof. The slot 641 opens through the top and the bottom thereof, and is located corresponding to the movement direction of the hook member 65 which will be described later.

An operation unit 6 located in the operation area 142 and has two slides 61, a toothed member 62 located between the two slides 61, a fixing member 63 mounted to the two slides 61 and a hook member 65. The two slides 61 are slidable left and right relative to the inside of the base 12. A notch 611 is defined in one side of each of the two slides 61 and a spring 612 is received in the notch 611. The spring 612 is biased between an inside of the notch 611 and the fixing member 63. Each slide 61 has a control member 66 which is located corresponding to the inside of the base 12. Each control member 66 has a protrusion 661 which protrudes toward the toothed member 62, the toothed member 62 having teeth 621 on the distal end thereof. Two shifting members 622 respectively extend from two sides of the toothed member 62. The shifting members 622 contact the protrusions 661 of the two control members 66. The slide 61 located above and corresponding to the toothed member 62 has a rod 613 extending therefrom and located opposite to the notch 611. The other slide 61 is located corresponding to the groove 41 of the shackle 4 and has a block 614 extending therefrom which is engaged with the groove 41 to position the first end of the shackle 4. The hook member 65 is located between the board 3 and the fixing member 63, and one end of the hook member 65 is movably inserted in the slot 641 to be engaged with the cover 11. The hook member 65 has a push member 651 which has an inclined face 652 that contacts the rod 613. The hook member 65 has a stop 653 opposite to the push member 651. A tension spring 654 is biased between the underside of the stop 653 and an auxiliary member 31 extending from the board 3.

An electric control unit 7 has a motor 71 and a circuit board 72 which is connected to the underside of the touch screen 2 of the cover 11 and electrically connected with the touch screen 2 and the power supply member 15. The motor 71 is located between the two slides 61 and electrically connected with the circuit board 72. The motor 71 has a driving disk 73 which is engaged with the toothed member 62 orthogonally. The circuit board 72 controls the motor 71 to drive the driving disk 73 to rotate the toothed member 62. The user may operates the touch screen 2 on the cover 11 to activate the motor 71 to control the toothed member 62 so as to move the shifting members 622 to move the slides 61.

When the motor 61 drives the driving disk 73 clockwise, the toothed member 62 rotates counter clockwise to move the slide 61 located beneath the toothed member 62 from the shackle 4. The first end of the shackle 4 is pushed by the resilient member 5 and pops out from the base 12. When the motor 71 drives the driving disk 73 counter clockwise, the toothed member 62 rotates clockwise to move the slide 61 located above the toothed member 62 to move the hook member 65 to be disengaged from the cover 11, so that the cover 11 is pivoted away from the base 12.

As shown in FIGS. 5 to 11, when the user wants to unlock the lock unit, the shackle 4 is disengaged from the base 12, by inputting correct numbers, commands or finger print, the circuit board 72 activates the motor 71 which drives the driving disk 73 clockwise, the toothed member 62 rotates counter clockwise. One of the shifting members 622 pushes the protrusion 661 of the control member 66 to move toward the direction that the toothed member 62 rotates. In the meanwhile, the control member 66 also moves the slide 61 to the same direction so that the rod 613 pushes the push member 651 of the hook member 65 and moves along the inclined face 652 to move the hook member 65 downward. The downward movement of the hook member 65 disengages from the cover 11, so that the cover 11 can be pivoted away from the base 12 and the key in the first room 13 is accessed.

Figure 12:
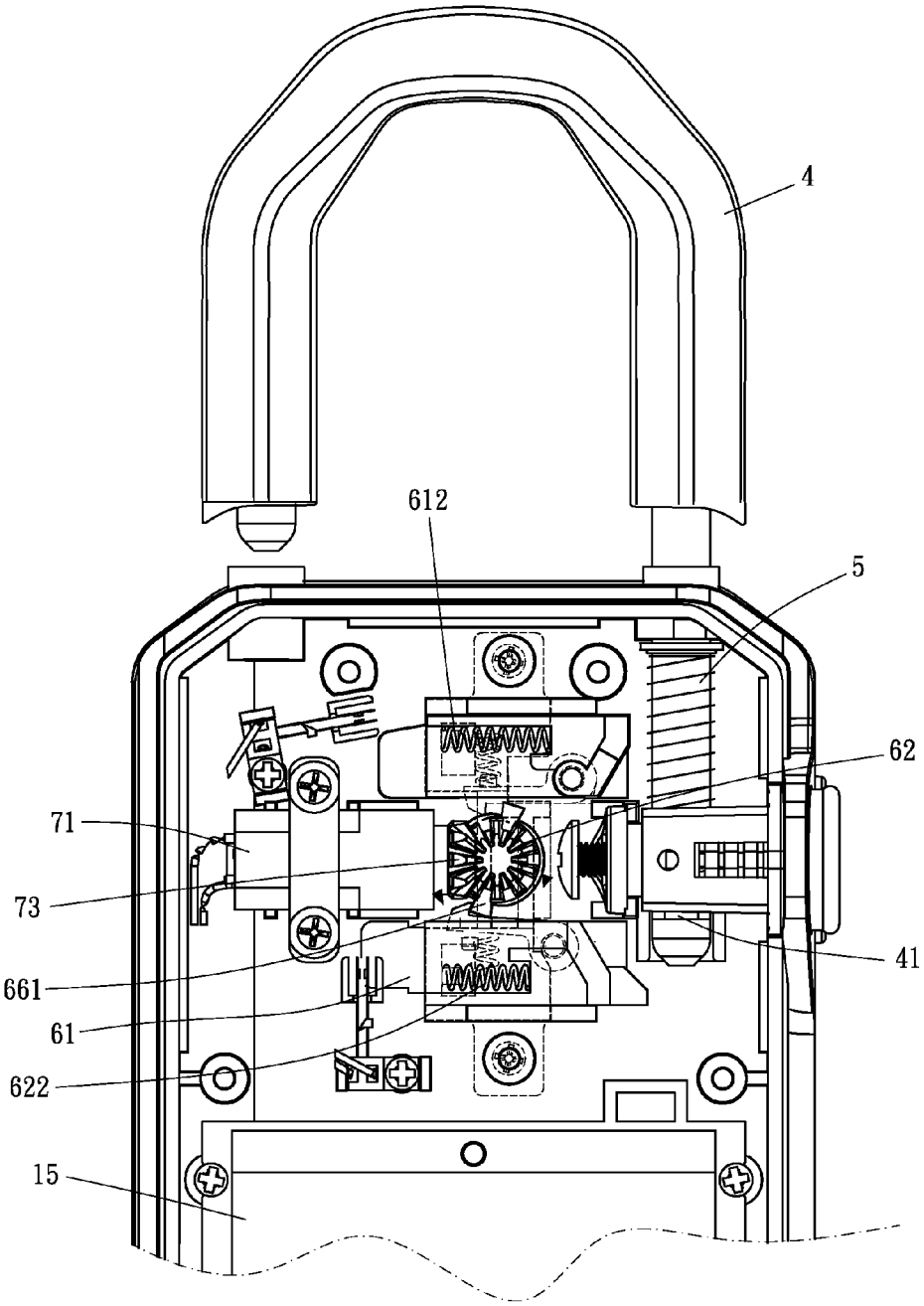
FIG. 12 shows that the motor is operated counter clockwise and the toothed member is rotated clockwise, the slide beneath the toothed member moves.
Figure 13:
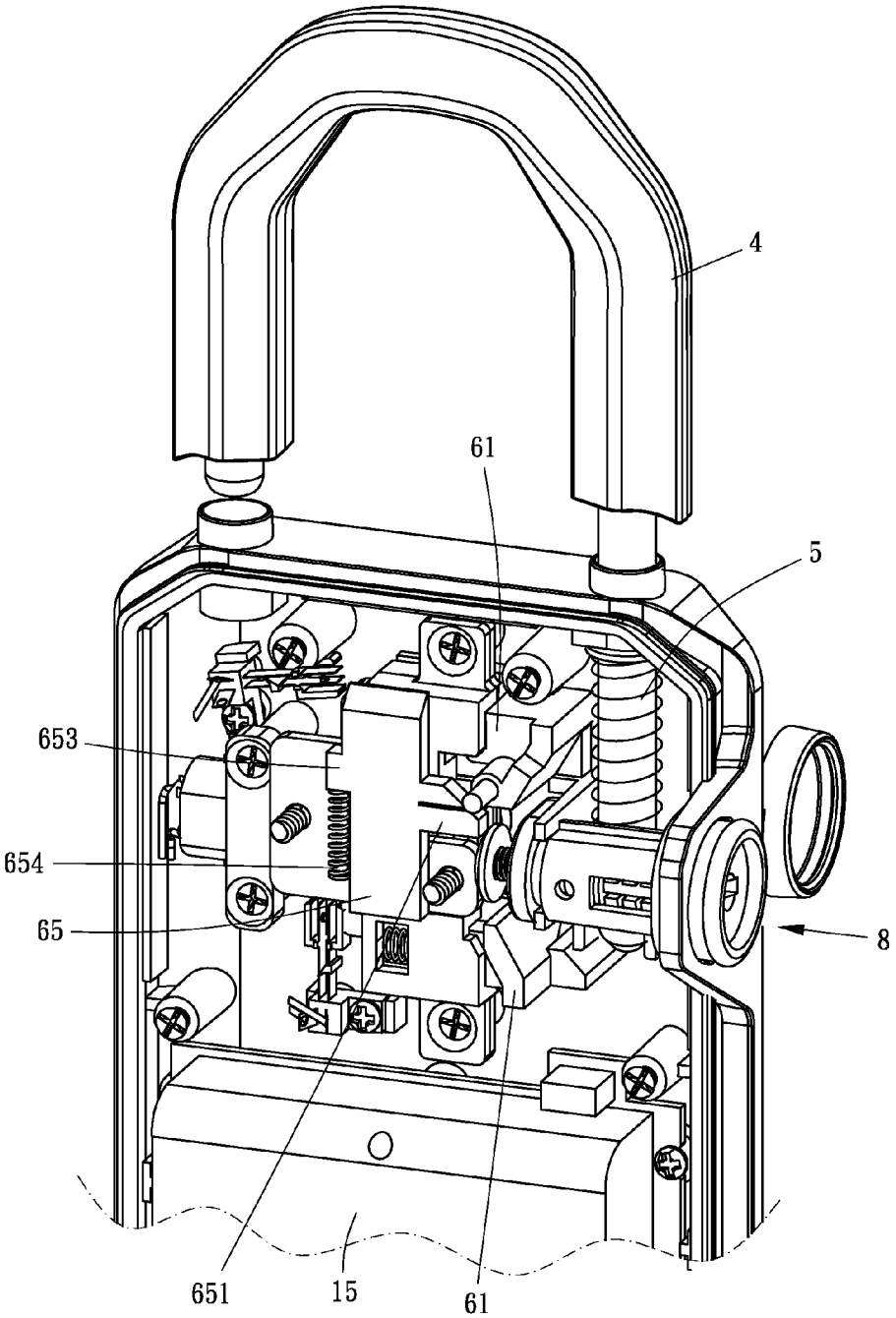
FIG. 13 shows that when the slide beneath the toothed member moves, the block is disengaged from the shackle.
Figure 14:
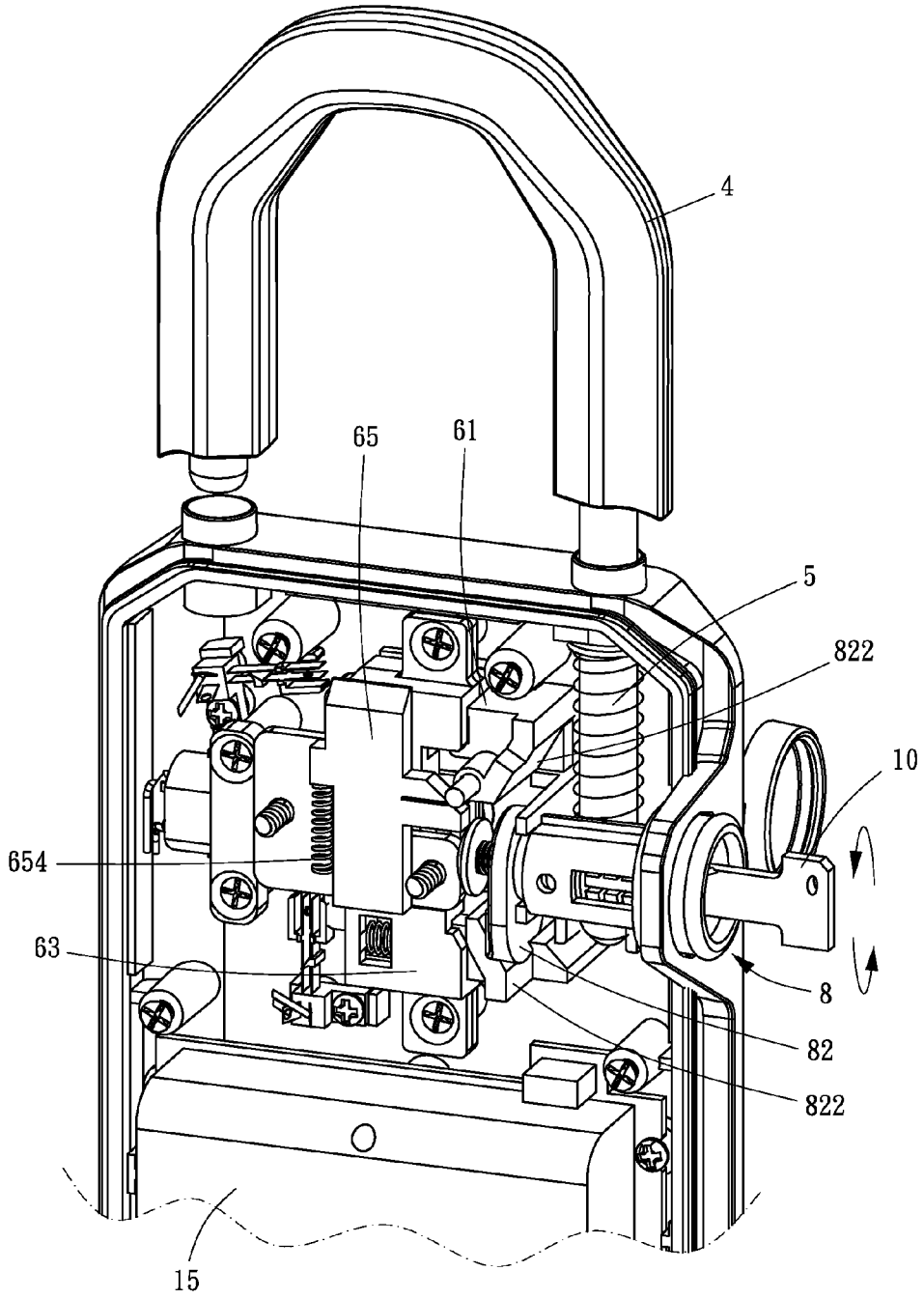
FIG. 14 shows lock core is unlocked by using the key.
Figure 15:
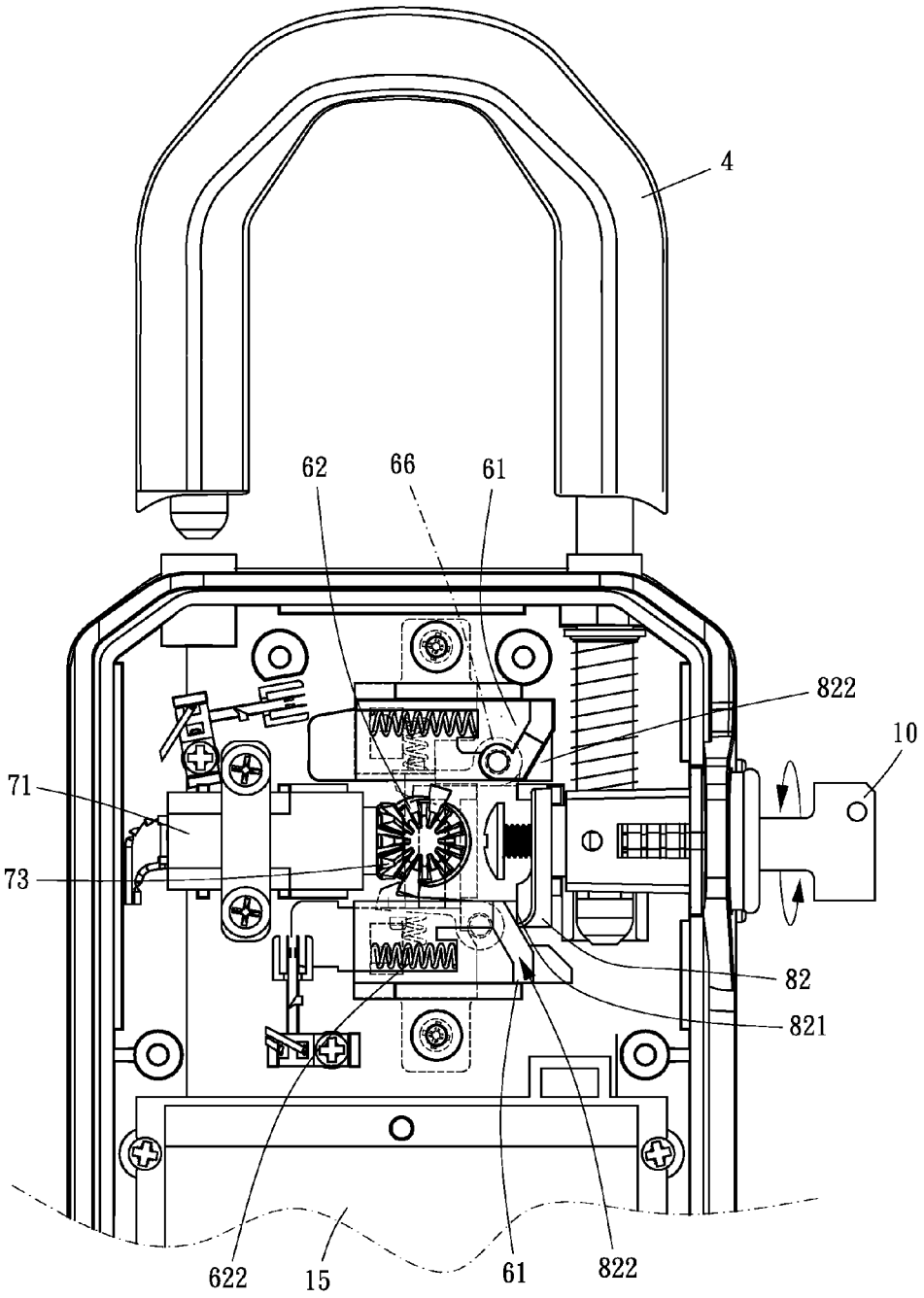
FIG. 15 shows that the plate is rotated due to the rotation of the lock core, and the curved member pushes the two slides.

As shown in FIGS. 12 and 13, when the motor 61 drives the driving disk 73 counter clockwise, the toothed member 62 rotates clockwise to activates the other shafting member 622 to push the protrusion 661 of the control member 66, and further pushes the slide 61 to move transversely. The block 614 is disengaged from the groove 41 of the shackle 4 because of the movement of the slide 61. When block 614 is disengaged from the groove 41 of the shackle 4, the resilient member 5 pushes the first end of the shackle 4 out from the base 12. When the first end of the shackle 4 is again inserted into the base 12, the shackle 4 is locked again.

As shown in FIGS. 2, 9, 10 and 11, the fixing member 63 has two pins 631 extending therefrom and the springs 612 are mounted to the two pins 631 of the fixing member 63, such that the springs 612 are well positioned. Two locking members 632 extend from two ends of the underside thereof, and two bolts 633 extend through the locking members 632 to lock the fixing member 63 to the base 12. Therefore, the fixing member 63 protects the spring 612 from being disengaged from its position. Each of the slides 61 has a spring 615 connected thereto which is biased between the slide 61 and the control member 66 corresponding thereto so as to control the movement of the control member 66. Each slide 61 has a column 616 so that the spring 615 is connected between the two columns 616 and does not disengaged from its position. The springs 615 provide a proper resilience so that the control members 66 are resiliently movable.

As shown in FIGS. 2, 9, 10, 11 and 17, when the cover 11 is opened relative to the base 12, the restriction member 64 has two posts 642 extending from two ends thereof. A spring 643 is mounted to each post 642 and biased between the restriction member 64 and the inside of the cover 11. The springs 643 allow the cover 11 to be automatically opened relative to the base 12 when the hook member 65 is disengaged from the cover 11. In order to securely close the cover 11 to the base, the cover 11 has two tabs 111. The hook member 65 is engaged between the two tabs 111 to restrict the cover 11 from being pivoted away from the base 12.

As shown in FIGS. 5 to 15, in order to avoid a situation that the touch screen 2 is not operatable, a lock core 8 is connected to the base 12 and located corresponding to the first end of the shackle 4. The lock core 8 has a keyhole 81 defined in the first end thereof which is exposed from the base 12, and the second end of the lock core 8 is located in the base 12 and has a plate 82 connected thereto. The plate 82 has a curved member 821 extending perpendicularly therefrom which is located between the two slides 61 and extends toward the hook member 65. Each slide 61 has an inclined face 822 which is located corresponding to the curved member 821. The two respective inclined faces 822 of the two slides 61 are radially inclined toward opposite directions. When the lock core 8 is rotated, the curved member 821 is rotated to push the inclined faces 822 of the slides 61 which controls the first end of the shackle 4 to be disengaged from the base 12 so that the cover 11 is pivoted away from the base 12.

Because the power supply member 15 has electric power, and the parts of the operation unit 6 are made by metal, so that liquid or moist should be kept out from the power supply member 15 and the parts of the operation unit 6. A cover piece 9 is provided to be connected to the outside of the base 12. A link 91 is connected between the cover piece 9 and the base 12. The cover piece 9 covers the first end of the lock core 8 and the keyhole 81.

Figure 16:
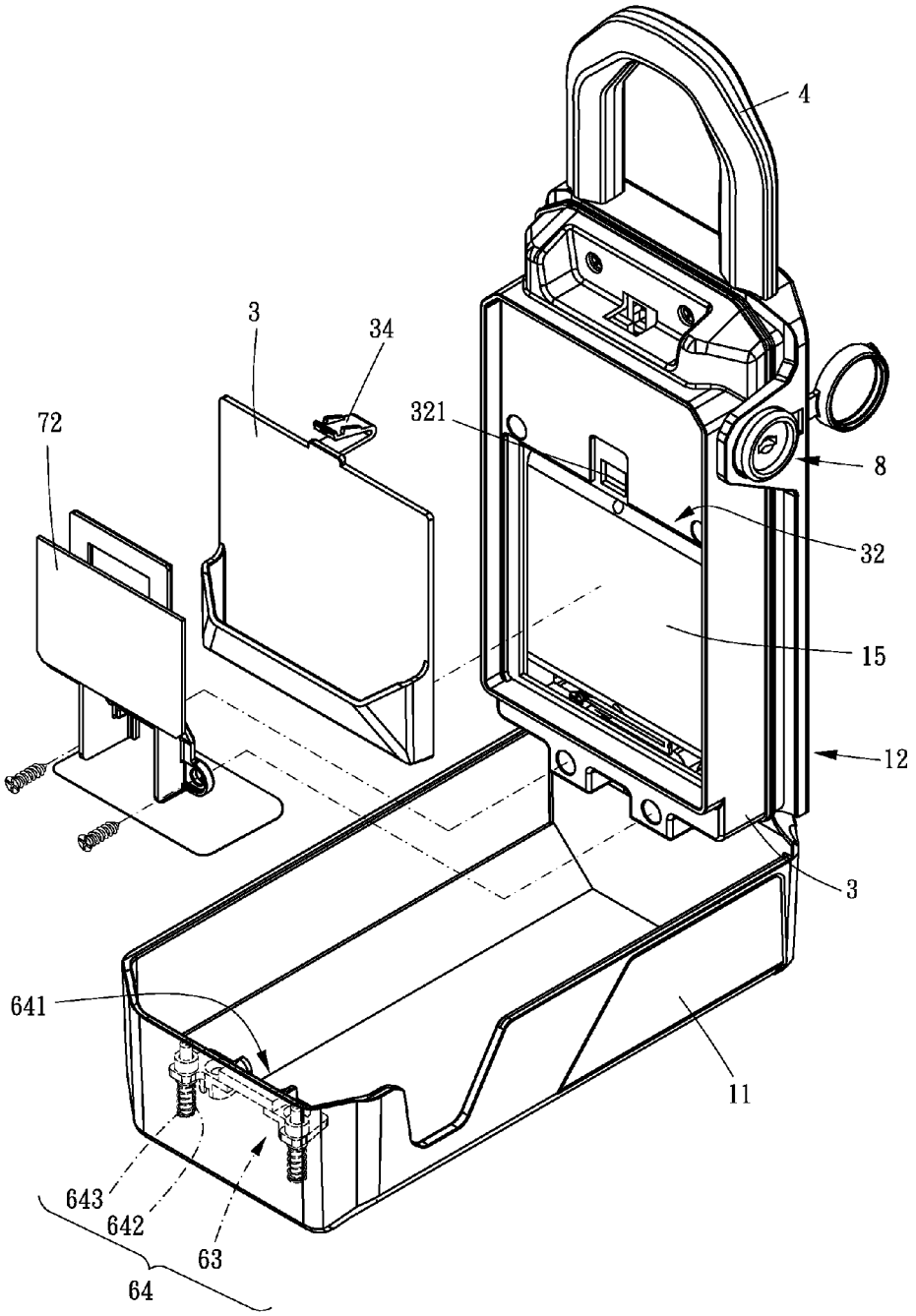
FIG. 16 shows that the circuit board and the board are removed from the case.
Figure 17:
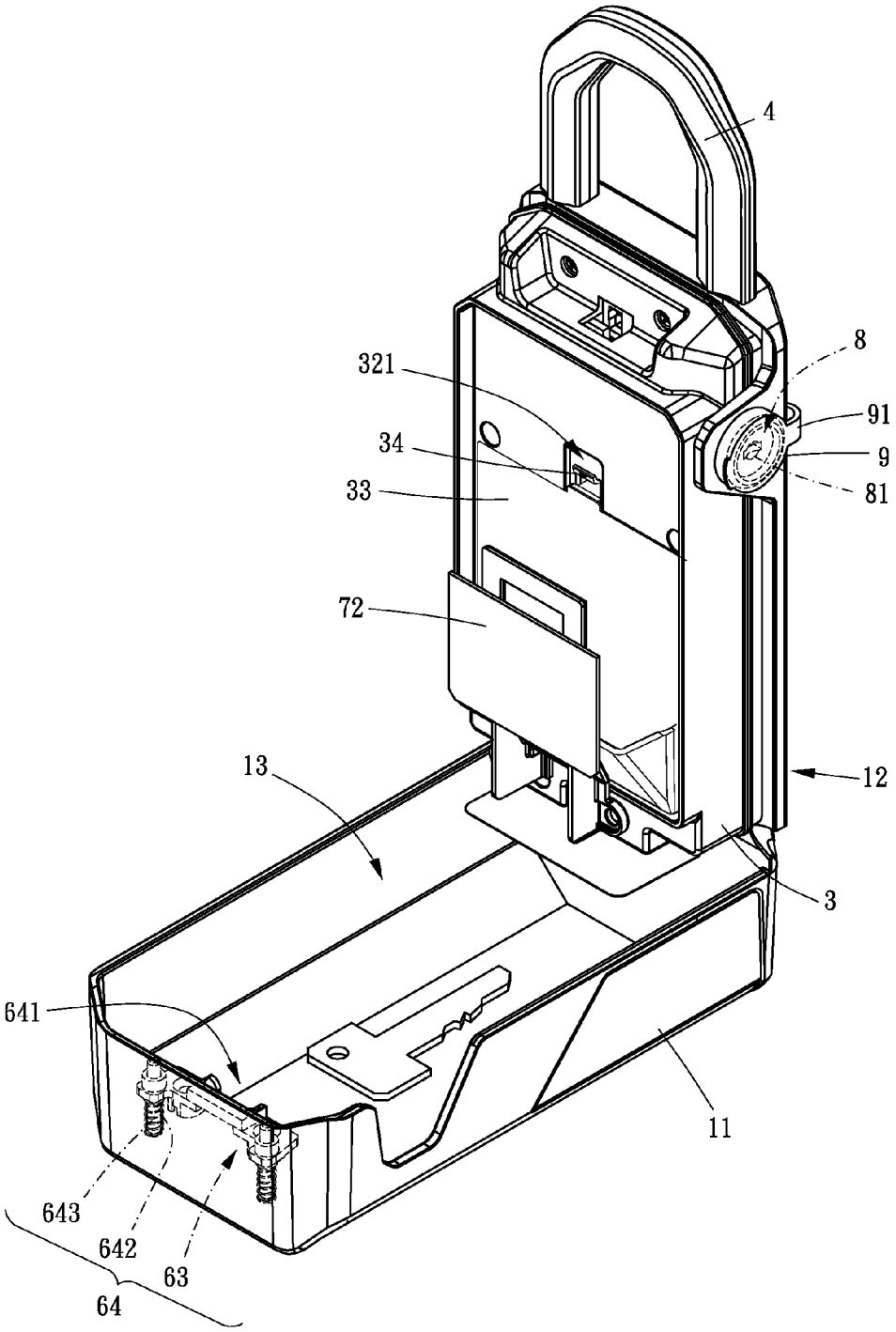
FIG. 17 shows that the key is received in the lock unit and accessed by unlock the lock unit.

As shown in FIG. 16, the board 3 has an opening 32 which communicates with the power supply area 141 and is located corresponding to the power supply member 15. A cap 33 is mounted to the opening 32 and covers the power supply member 15. The user can pull the cap 33 out from the board 3 to access the power supply member 15.

The opening 32 has a recess 321 defined in the top edge thereof, the cap 33 has a resilient piece 34 which is hooked with the recess 321 to fix the cap 33. The user pushes the resilient piece 34 and remove the cap 33 to replace or maintain the power supply member 15. The cap 33 can also be connected to the board 3 in different known ways.

While we have shown and described the embodiment in accordance with the present invention, it should be clear to those skilled in the art that further embodiments may be made without departing from the scope of the present invention.

What is claimed is:

1. A lock unit comprising:

a case having a cover and a base, the cover pivotably connected to a lower end of the base and having a touch screen on an outside thereof, a board located in the base to define a first room between the cover and the base, a second room defined between the board and an inside of the base, the second room having a power supply area and an operation area, a power supply located in the power supply area, a shackle having a first end and a second end, the first end of the shackle having a resilient member mounted thereto and a groove defined in a distal end thereof, the first and second ends of the shackle inserted into the operation area, a restriction member connected to an inside of the cover and located close to a top inside of the cover, the restriction member having a slot defined in a central portion thereof;

an operation unit located in the operation area and having two slides, a toothed member located between the two slides, a fixing member mounted to the two slides and a hook member, the two slides being slidable left and right relative to the inside of the base, a notch defined in one side of each of the two slides and a spring received in the notch, the spring being biased between an inside of the notch and the fixing member, each slide having a control member which is located corresponding to the inside of the base, each control member having a protrusion which protrudes toward the toothed member, the toothed member having teeth on a distal end thereof, two shifting members respectively extending from two sides of the toothed member, the shifting members contacting the protrusions of the two control members, the slide located corresponding to the toothed member having a rod extending therefrom and located opposite to the notch, the other slide located corresponding to the groove of the shackle having a block extending therefrom which is engaged with the groove to position the first end of the shackle, the hook member located between the board and the fixing member, one end of the hook member movably inserted in the slot to be engaged with the cover, the hook member having a push member which has an inclined face contacting the rod, the hook member having a stop opposite to the push member, a tension spring being biased between an underside of the stop and an auxiliary member extending from the board;

an electric control unit having a motor and a circuit board which is connected to an underside of the touch screen of the cover and electrically connected with the touch screen and the power supply member, the motor located between the two slides and electrically connected with the circuit board, the motor having a driving disk which is engaged with the toothed member orthogonally, the circuit board controlling the motor to drive the driving disk to rotate the toothed member, and the touch screen on the cover controlling the motor to control the toothed member so as to move the shifting members to move the slides, when the motor drives the driving disk counter clockwise, the toothed member rotates clockwise to move the slide located beneath the toothed member from the shackle, the first end of the shackle is pushed by the resilient member and pops out from the base, when the motor drives the driving disk clockwise, the toothed member rotates counter clockwise to move the slide located above the toothed member to move the hook member to be disengaged from the cover, so that the cover is pivoted away from the base.

2. The lock unit as claimed in claim 1, wherein the fixing member has two pins extending therefrom and the springs are mounted to the two pins of the fixing member, two locking members extend from two ends of an underside thereof, two bolts extend through the locking members to lock the fixing member to the base.

3. The lock unit as claimed in claim 1, wherein the restriction member has two posts extending from two ends thereof, a spring is mounted to each post and biased between the restriction member and the inside of the cover, the cover has two tabs, the hook member is engaged between the two tabs to restrict the cover from being pivoted away from the base.

4. The lock unit as claimed in claim 1, wherein each of the slides has a spring connected thereto which is biased between the slide and the control member corresponding thereto so as to control a movement of the control member.

5. The lock unit as claimed in claim 1, wherein a lock core is connected to the base and located corresponding to the first end of the shackle, the lock core has a keyhole defined in a first end thereof which is exposed from the base, a second end of the lock core in the base has a plate connected thereto, the plate has a curved member extending perpendicularly therefrom which is located between the two slides and extends toward the hook member, each slide has an inclined face which is located corresponding to the curved member, the two respective inclined faces of the two slides are radially inclined toward opposite directions, when the lock core is rotated, the curved member is rotated to push the inclined faces of the slides which controls the first end of the shackle to be disengaged from the base so that the cover is pivoted away from the base.

6. The lock unit as claimed in claim 5, wherein a cover piece is connected to an outside of the base, a link is connected between the cover piece and the base, the cover piece covers the first end of the lock core and the keyhole.

7. The lock unit as claimed in claim 1, wherein the board has an opening which communicates with the power supply area and is located corresponding to the power supply member, a cap is mounted to the opening and covers the power supply member.

8. The lock unit as claimed in claim 7, wherein the opening has a recess defined in a top edge thereof, the cap has a resilient piece which is hooked with the recess to fix the cap.

* * * * *